US006756076B2

(12) United States Patent
Brier

(10) Patent No.: US 6,756,076 B2
(45) Date of Patent: Jun. 29, 2004

(54) PROCESS FOR PRODUCING FABRIC ARTICLES HAVING WATER-RESISTANT AND/OR ANTIMICROBIAL CHARACTERISTICS

(76) Inventor: Michael Brier, 3968 - 194$^{th}$ Trail, Miami, FL (US) 33160

( * ) Notice: Subject to any disclaimer, the term of this patent is extended or adjusted under 35 U.S.C. 154(b) by 126 days.

(21) Appl. No.: 09/975,495

(22) Filed: Oct. 11, 2001

(65) Prior Publication Data

US 2002/0042956 A1 Apr. 18, 2002

Related U.S. Application Data

(60) Provisional application No. 60/240,423, filed on Oct. 13, 2000.

(51) Int. Cl.$^{7}$ ..... B05D 3/02
(52) U.S. Cl. ..... 427/379; 427/392
(58) Field of Search ..... 427/379, 392

(56) References Cited

U.S. PATENT DOCUMENTS

| | | | | |
|---|---|---|---|---|
| 3,817,702 A | | 6/1974 | Paulus | |
| 3,870,542 A | | 3/1975 | Ida | |
| 3,976,818 A | * | 8/1976 | Connick et al. | 427/381 |
| 4,008,351 A | | 2/1977 | Inoue | |
| 4,053,670 A | | 10/1977 | LePoutre | |
| 4,090,844 A | | 5/1978 | Rowland | |
| 4,172,841 A | | 10/1979 | Danna | |
| 4,199,322 A | | 4/1980 | Danna | |
| 4,390,650 A | * | 6/1983 | Deiner et al. | 524/266 |
| 4,430,381 A | | 2/1984 | Harvey | |
| 4,615,937 A | | 10/1986 | Bouchette | |
| 4,826,497 A | | 5/1989 | Marcus | |
| 5,152,996 A | | 10/1992 | Corey | |
| 5,707,736 A | | 1/1998 | Levy | |
| 5,770,308 A | | 6/1998 | Suzuki | |
| 5,874,148 A | | 2/1999 | Hough | |
| 5,968,207 A | * | 10/1999 | Li | 8/490 |
| 6,077,794 A | * | 6/2000 | Tabata et al. | 442/123 |

FOREIGN PATENT DOCUMENTS

| | | |
|---|---|---|
| JP | 01-213484 | * 8/1989 |
| RO | 109225 | * 12/1994 |

* cited by examiner

*Primary Examiner*—Erma Cameron
(74) *Attorney, Agent, or Firm*—Mark D. Bowen, Esq.; Stearns Weaver Miller Weissler Alhadeff & Sitterson, P.A.

(57) ABSTRACT

A process for producing hydrophobic cotton fabric useful as material for forming a wide variety of useful articles. The process includes the steps of (1) bleaching the cotton fabric with a suitable optical whitener; (2) affixing the fabric to a conveying machine; (3) applying approximately 7 lbs. of water resistance substance for each approximately 100 lbs. of fabric by conveying the fabric through a pad bath; (4) conveying the fabric through a tenter frame machine having a heating chamber set a approximately 340° F.; (4) conveying the treated fabric through the heating chamber at a speed of approximately 17 yards per minute; (5) repeating step 4 a second time to effect curing of the chemicals thereby resulting in a water-resistant cotton fabric. Alternate methods are disclosed for treating fabric with various antimicrobial, antifungal, anti-odor and/or anti-stain substances. Fabric produced according to the above-referenced process is suitable for use in a wide variety of useful articles such as undergarments for those suffering from incontinence, feminine shields, bedding products such as mattress pads and covers, apparel such as t-shirts, lingerie, and medical gowns.

5 Claims, 1 Drawing Sheet

PROCESS FOR PRODUCING FABRIC ARTICLES HAVING WATER-RESISTANT AND/OR ANTIMICROBIAL CHARACTERISTICS

CROSS-REFERENCE TO RELATED APPLICATIONS

This application claims the benefit of provisional U.S. patent application Ser. No. 60/240,423, filed Oct. 13, 2000.

STATEMENT REGARDING FEDERALLY SPONSORED RESEARCH OR DEVELOPMENT

BACKGROUND OF THE INVENTION

1. Field of the Invention

The present invention relates to textiles, and more particularly to a process for producing cotton fabric and fabric blends having various water-resistant, stain-resistant, anti-odor, antibacterial, and antifungal characteristics and useful clothing and/or undergarment articles produced therefrom.

2. Description of Related Art

The use of cotton in fabric materials is well known. Cotton has been spun, woven, and dyed for centuries and is widely available. Cotton fabric, however, has an affinity for absorbing water and usually absorbs water and other liquids immediately upon contact. While water absorption may be a desirable characteristic for cotton fabric in certain applications, it is quite an undesirable characteristic in others. Cotton fabric is commonly used to produce undergarments and articles of clothing.

Urinary incontinence is the loss of bladder control or the leakage of urine, and is a very common condition afflicting older people. Statistics indicate that as many as 5 in 10 people over the age of 65 suffer from incontinence. It is a condition that ranges from mild leakage to uncontrollable and embarrassing wetting. Urinary incontinence is a major health problem because it can lead to disability and dependency. As a result, undergarment products have become available to provide discrete, comfortable protection for persons suffering from urinary incontinence.

Accordingly there exists a need for a water-resistant cotton fabric for use in producing fabric products such as undergarments and the like.

In addition, there exists a need for a cotton fabric impregnated with antifungal and antibacterial compounds to preserve hygienic freshness.

BRIEF SUMMARY OF THE INVENTION

The present invention provides a process for producing a water-resistant fabric from cotton and clothing and undergarment articles produced therefrom. In an alternate embodiment, the present invention further provides cotton fabric treated with antibacterial and/or antifungal compounds, and anti-odor compounds.

In a preferred embodiment, there is disclosed a process for producing hydrophobic (e.g. water-resistant) cotton fabric via a multi-step manufacturing process that results in a fabric that retains its hydrophobic characteristics even after numerous machine washing. Cotton fabric manufactured according to the process disclosed herein is suitable for use in various applications wherein a hydrophobic cotton material is desired, such as clothing, undergarments, incontinence products, underarm cotton shields, bedding products such as mattress pads and covers, diapers, apparel and lingerie items, furniture coverings and fabric, curtains, gloves, footwear, headwear, tents, sleeping bags, lab coats, etc.

In an alternate embodiment the present invention further contemplates a process for producing hydrophobic cotton fabric impregnated with antimicrobials, such as antibacterial, anti-odor, and antifungal substances. Cotton fabric having antimicrobial characteristics may be used to produce a wide variety of personal undergarments and the like and functions to inhibit the growth of odor-causing bacteria, fungi, molds and mildew. As a result, the fabric possesses a characteristic that does not mask odors, but instead, works on preventing the actual causes of odors. The fabric further promotes hygiene by reducing the number of germs that can be transmitted and further by reducing the potential for allergic responses.

Accordingly, it is an object of the present invention to provide a process for producing water-resistant cotton fabric techniques. The present invention further contemplates producing stain-resistant fabric using similar techniques.

Still another object of the present invention is to provide useful articles such as undergarments, bedding products, and other personal products fabricated from water-resistant cotton fabric.

Still another object of the present invention is to provide non-woven articles produced in accordance with the process disclosed herein such that the articles possess water-resistant and anti-microbial characteristics.

In accordance with these and other objects that will become apparent hereinafter, the instant invention will now be described.

DETAILED DESCRIPTION OF THE INVENTION

Figure 1:
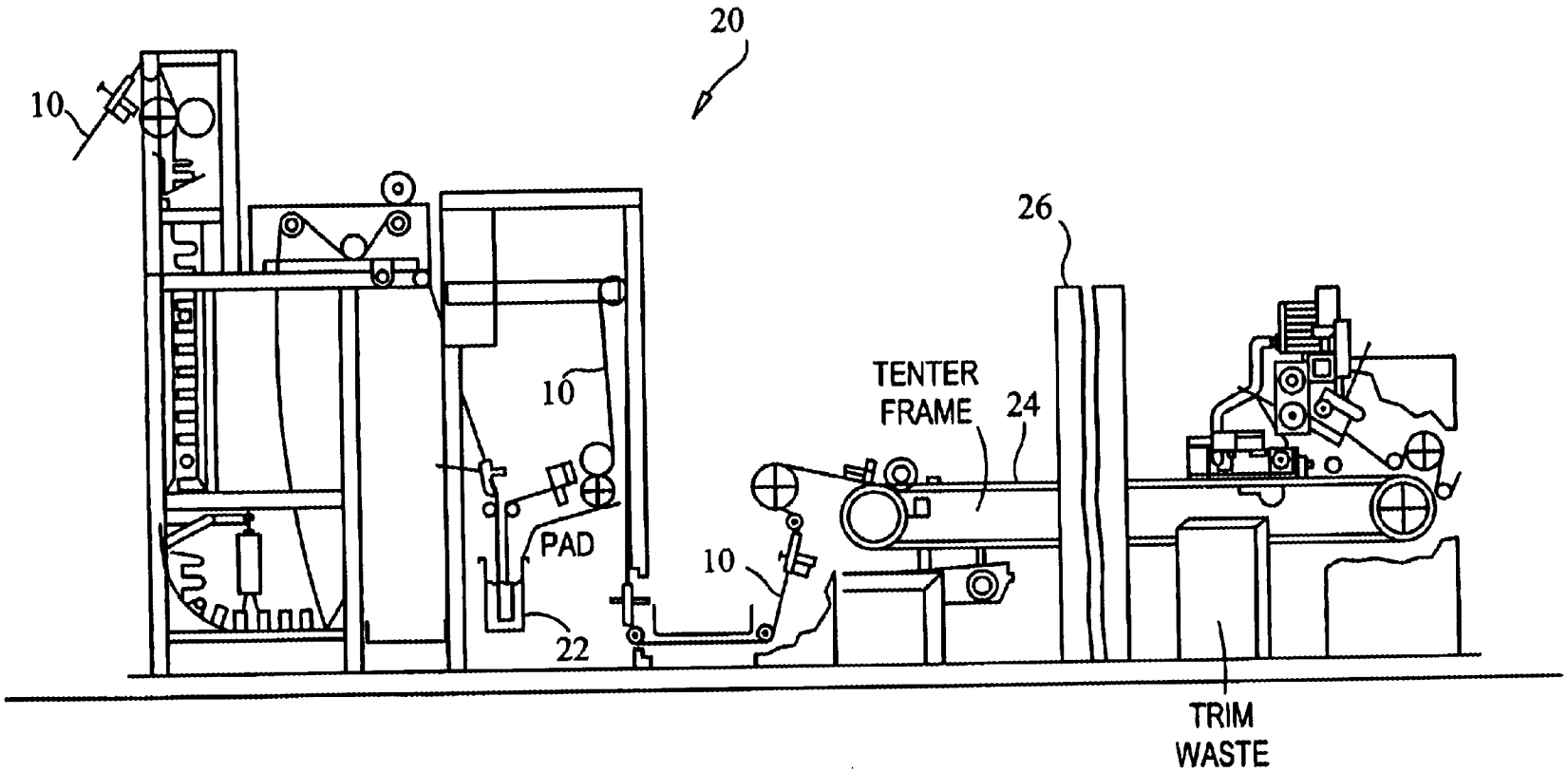
FIG. 1 depicts a fabric conveying and processing apparatus suitable for use with the present invention.

The instant invention provides a process for producing hydrophobic cotton fabric useful as material for forming a wide variety of useful articles. The process according to the present invention includes the steps of: (1) bleaching the cotton fabric with a suitable optical whitener; (2) affixing the fabric to a conveying machine; (3) applying approximately 7 lbs. of a water resistance solution, comprising of 5 lbs. of Marpel FC and 2 lbs. of Marpel SG, for each approximately 100 lbs. of fabric by conveying the fabric through a pad bath; (4) conveying the fabric through a tenter frame machine having a heating chamber set a approximately 340° F.; (4) conveying the treated fabric through the heating chamber at a speed of approximately 17 yards per minute; (5) repeating step 4 a second time to effect curing of the chemicals thereby resulting in a water-resistant cotton fabric. The names Marpel SG and Marpel FC are trademarks for chemicals produced by Marlin Chemical Company, 1211 Underdown Ave., Lenoir, N.C. 28645. Another suitable water repelling agent is identified as Apex Waterprofer 253.

The bleaching process typically includes use of a suitable optical brightener for whitening the fabric. Common bleaching agents include, chlorine, peroxide, and reducing agents such as sulphites. Bleaching is used to remove natural or other types of impurities. The bleaching agent may be centrifugally extracted after a predetermined period of time. A tenter is a machine that dries and stretches cloth to its finished width, and straightens the weave by the action of two diverging endless chains. Each chain is equipped with a series of clips or pins that hold the edges of the cloth and convey it over gas flames or through a hot-air drying compartment.

FIG. 1 discloses a fabric conveying and processing apparatus suitable for use in treating fabric according to the present invention. The apparatus itself does not comprise a part of the invention, but is referenced herein to illustrate application of the disclosed process. As best seen in FIG. 1 fabric, referenced as 10, is fed into a conveying apparatus, generally referenced as 20. The fabric is conveyed through a pad bath 22 wherein various chemical substances are applied. The fabric is subsequently conveyed to a tenter frame apparatus 24 that causes the fabric to pass through a heating chamber 26.

Once treated the fabric's fiber surface is effectively altered to make it repel water. It has been found that water drops are repelled by the treated fabric and run over the surface rather than being absorbed, while the mechanical properties, the visual appearance, and the permeability for air remain unchanged. Cotton fabric treated in accordance with the process of the instant invention remains substantially hydrophobic for extended periods and numerous machine washings.

Hydrophobic cotton fabric produced according to the above-referenced process is suitable for use in a wide variety of useful articles such as undergarments for those suffering from incontinence, feminine shields, bedding products such as mattress pads and covers, apparel such as t-shirts, lingerie, and medical gowns. In addition, other articles may be produced from non-woven materials treated in accordance with the processes disclosed herein.

The present invention further contemplates a process for producing hydrophobic cotton fabric impregnated with antimicrobials, such as antibacterial, anti-odor, and antifungal substances. Cotton fabric having antimicrobial characteristics may be used to produce a wide variety of clothing and/or personal undergarments and the like and functions to inhibit the growth of odor-causing bacteria, fungi, molds and mildew. As a result, the fabric possesses a characteristic that will mask odors, but also prevents the actual causes of odors. The fabric further promotes hygiene by reducing the number of germs that can be transmitted and further by reducing the potential for allergic responses.

Accordingly, the process may be adapted to produce fabric having both antibacterial and water repellant properties according to the following steps: (1) bleaching the cotton fabric with a suitable optical whitener; (2) affixing the fabric to a conveying machine; (3) applying approximately 3 lbs. of antibacterial substance and 2 lbs. of water repellant for each approximately 100 lbs. of cotton fabric by conveying the fabric through a pad bath; (4) conveying the fabric through a tenter frame machine having a heating device set for approximately 325° F. at a speed of approximately 40 yards per minute; (5) repeating step (4) a second time to effect curing of the chemicals thereby resulting in a water-resistant cotton fabric.

A suitable bacteriostat for textiles is available from Marlin Chemical Company or Lenoir, N.C., under the trademark Microfin Protectant 100. The active ingredient of Microfin Protectant 100 is triclosan (a trademark for 2,4,4-trichloro-2 hydroxydiphenyl ether), a phenolic derivative emulsified in water so that it can be applied to textiles to impart high resistance to the growth of bacteria durable to many washings. In alternate embodiments, the present invention contemplates use of antibacterial and antifungal compounds such as those available from Thompson Research Associates, a subsidiary of Kroy Chemicals, Ltd. (e.g. NMB2 Antibacterial), however the use of any suitable equivalent compounds is considered within the scope of the present invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A process for producing hydrophobic cotton fabric, said process including the steps of:

(1) bleaching cotton fabric with an optical whitener;

(2) affixing the fabric to a conveying machine;

(3) applying 7 lbs. of water resistance chemical solution for each approximately 100 lbs. of fabric by conveying the fabric through a pad bath;

(4) conveying the fabric through a tenter frame machine having a heating chamber set a approximately 340° F., such that the fabric passes through the heating chamber at a speed of approximately 17 yards per minute; and (5) repeating step (4) a second time to effect curing of the chemical solution thereby resulting in a water-resistant cotton fabric.

2. A process for producing hydrophobic cotton fabric according to claim 1, wherein step (3) further includes applying an antibacterial solution.

3. A process for producing hydrophobic cotton fabric according to claim 2 wherein said antibacterial solution includes 2.4.4-trichloro-2 hydroxydiphenyl ether.

4. A process for producing hydrophobic cotton fabric according to claim 1, further including the step of applying an anti-stain substance to said fabric.

5. A process for producing cotton fabric having hydrophobic and antimicrobial properties, said process including the steps of:

(1) affixing the fabric to a conveying machine;

(2) applying approximately 3 lbs. of antibacterial substance and 2 lbs. of water repellant for each approximately 100 lbs. of fabric by conveying said fabric through a pad bath;

(3) conveying said treated fabric through a tenter frame machine having a heating device set for approximately 325° F. at a speed of approximately 40 yards per minute; and (4) repeating step (3) a second time to effect curing of the substances thereby resulting in a water-resistant cotton fabric having antimicrobial properties.

* * * * *